US012648659B2

(12) United States Patent
Brady

(10) Patent No.: US 12,648,659 B2
(45) Date of Patent: Jun. 9, 2026

(54) GARMENT HANGER WITH INTEGRATED SPACING MECHANISM FOR WRINKLE-FREE STORAGE

(71) Applicant: Joel Brady, Fort Lauderdale, FL (US)

(72) Inventor: Joel Brady, Fort Lauderdale, FL (US)

( * ) Notice: Subject to any disclaimer, the term of this patent is extended or adjusted under 35 U.S.C. 154(b) by 0 days.

(21) Appl. No.: 18/903,987

(22) Filed: Oct. 1, 2024

(65) Prior Publication Data

US 2026/0090667 A1 Apr. 2, 2026

(51) Int. Cl.
*A47G 25/20* (2006.01)
*A47G 25/30* (2006.01)

(52) U.S. Cl.
CPC ..... *A47G 25/20* (2013.01); *A47G 25/30* (2013.01)

(58) Field of Classification Search
CPC ..... A47G 25/14; A47G 25/1442; A47G 25/1471; A47G 25/20; A47G 25/28; A47G 25/30; A47G 25/32; A47G 25/34; A47G 25/36
See application file for complete search history.

(56) References Cited

U.S. PATENT DOCUMENTS 1,461,442 A * 7/1923 Duberstein ..... A47G 25/30 223/92
2,895,618 A * 7/1959 Nathan ..... A47G 25/0692 211/123
2,989,191 A * 6/1961 Eason ..... A47G 25/32 211/113
3,024,953 A * 3/1962 O'Keefe ..... A47G 25/1421 40/322
3,067,917 A * 12/1962 Reller ..... A47G 25/28 223/91
3,112,050 A * 11/1963 Eason ..... A47G 25/32 40/322
3,482,746 A * 12/1969 Ferguson ..... A47G 25/1471 223/85

(Continued)

FOREIGN PATENT DOCUMENTS

GB 2052969 A * 2/1981 ..... A47G 25/1471

*Primary Examiner* — F Griffin Hall
(74) *Attorney, Agent, or Firm* — Origins Law, LLC; Nicholas Spatola

(57) ABSTRACT

A garment hanger and system for promoting wrinkle-free storage and organization is disclosed. The hanger comprises a unitary frame body with shoulders and a top hook, featuring an integrated garment spacer. The top hook includes contact surfaces on each side, configured to abut against adjacent hangers while maintaining space between hung garments. The frame body maintains a continuous geometrical cross-section throughout, forming an H-shaped profile for improved strength and reduced weight. A textured top surface on each shoulder prevents garment slippage, while notches accommodate strapped garments. The hanger's width is elongated beyond standard dimensions to prevent shoulder bumps in garments. When multiple hangers are arranged on a support bar, the contact surfaces ensure uniform spacing, promoting airflow and reducing wrinkling. The design enhances overall structural integrity, accommodating various garment types without compromising hanger durability or garment condition. A method for organizing garments using this hanger system is also presented.

18 Claims, 12 Drawing Sheets

(56) References Cited

U.S. PATENT DOCUMENTS

| | | | | | |
|---|---|---|---|---|---|
| 3,527,358 | A * | 9/1970 | Wheeler | A47G 25/32 | 248/691 |
| 4,415,093 | A * | 11/1983 | Livingston | A47G 25/1471 | 211/113 |
| 5,170,916 | A * | 12/1992 | Kolton | A47G 25/30 | 223/92 |
| 5,535,927 | A * | 7/1996 | Garrison | A47G 25/30 | 223/92 |
| D383,910 | S * | 9/1997 | Maxwell | D6/328 | |
| D393,371 | S * | 4/1998 | Dunn | D25/108 | |
| 7,201,297 | B1 * | 4/2007 | Baziuk | A47G 25/32 | 223/85 |
| D644,845 | S * | 9/2011 | Brady | D6/319 | |
| D662,717 | S * | 7/2012 | Brady | D6/318 | |
| 8,256,650 | B2 * | 9/2012 | Sokol | A47G 25/442 | 223/89 |
| 9,782,030 | B1 * | 10/2017 | Bell | A47G 25/1471 | |
| 2010/0219215 | A1 * | 9/2010 | Davis | A47G 25/28 | 29/428 |

* cited by examiner

GARMENT HANGER WITH INTEGRATED SPACING MECHANISM FOR WRINKLE-FREE STORAGE

FIELD OF THE INVENTION

The present invention relates to garment hangers, specifically to an improved hanger design that promotes wrinkle-free storage and organized appearance of hung garments.

BACKGROUND

Garment hangers have been a fundamental tool in clothing storage for over a century, with designs evolving to meet the needs of both domestic and commercial users. Traditional hangers are typically made from materials such as wood, wire, or plastic and are designed to maximize the vertical space in closets. Despite their widespread use, conventional hanger designs have remained relatively unchanged over the years, with most innovations focusing on increasing storage capacity or improving portability. While these innovations address some aspects of garment storage, they often fail to tackle persistent issues such as garment wrinkling, shoulder deformities, and slippage.

Current garment hangers encompass a variety of designs including wire, plastic, and wooden constructions with diverse shapes and features. These hangers typically support garments by draping them over a horizontal bar or shoulders, with some designs incorporating additional elements like clips or bars for pants. However, existing hangers often fall short in addressing key issues: they frequently contribute to garment wrinkling due to compression and lack of airflow; they create shoulder bumps in clothing, especially in larger garments, due to inadequate support along the shoulder line; they often fail to prevent garments from sliding off, leading to disorganization; and they rarely maintain consistent spacing between hung items, resulting in overcrowding and further wrinkling. These limitations not only affect the appearance and longevity of garments but also impact the overall organization and efficiency of closet spaces, highlighting the need for an improved hanger design.

Traditional hangers often lead to several common problems that compromise garment care and closet organization. One significant issue is wrinkling, which occurs when garments are compressed against each other due to the narrow profile of typical hangers. This compression not only creates creases in fabrics but also limits airflow between garments, which can lead to moisture build-up and unpleasant odors. Another prevalent issue is the formation of shoulder bumps, particularly in larger shirts and jackets. These deformations result from inadequate support along the shoulder line, where narrow or sharply angled hangers create pressure points. Additionally, many traditional hangers lack features to prevent slippage, causing garments to slide off and end up disorganized or on the floor.

The need for an improved hanger design is evident from the limitations of existing solutions. Consumers seek hangers that not only support a variety of garment types but also enhance the overall appearance and organization of their closets. There is a demand for hangers that provide adequate spacing between garments to prevent wrinkling, maintain the natural shape of garments to avoid shoulder bumps, and offer features that secure clothes in place to prevent slippage. Furthermore, these improvements should not compromise the structural integrity of the hanger, as it must be capable of supporting heavier garments without bending or breaking.

The ideal hanger design would address all these issues while being easy to use and maintain.

Thus, a need exists in the market for a garment hanger and associated garment hanger system that provides a system increasing the space between garments promoting airflow and minimizing garment to garment contact, provides a strong but lightweight construction that is capable of securely hanging even the heaviest of garments, provides a garment hanger having a textured upper interacting surface to prevent slippage of a hanging garment, and provides an integrated solution that incorporates the features into a simple and easily producible apparatus that can be grouped and provided as a system.

SUMMARY OF THE INVENTION

The present invention relates to garment hangers, specifically to a hanger design that addresses common issues such as garment wrinkling, shoulder bumps, and disorganized closet appearance. This innovative design provides a more efficient, effective, and aesthetically pleasing solution for both personal and commercial garment storage needs.

The invention disclosed herein provides a garment hanger for promoting wrinkle-free storage and organization. The garment hanger comprises a unitary frame body comprising shoulders and a top hook for engaging with a support bar. The pair of shoulders extending outwardly and angled downwardly from opposite sides of the top hook, thereby forming a triangular shape below the top hook. The top hook includes an integrated garment spacer wherein the integrated garment spacer is defined as depth greater than the depth of the pair of shoulders, whereby the top hook provides for the maintaining of space between hung garments by allowing the top hooks of adjacent hangers to touch while preventing contact between the hung garments. As used herein, the term 'hook-shaped garment spacer' refers to the top hook including the integrated garment spacer as described above.

The invention disclosed herein provides a garment hanging system for maintaining organized and wrinkle-free storage of multiple garments. The system comprises a support bar and a plurality of garment hangers. The garment hangers are configured to hang on the support bar. Each garment hanger comprises a unitary frame body comprising shoulders and a top hook for engaging with a support bar. The pair of shoulders extending outwardly and angled downwardly from opposite sides of the top hook, thereby forming a triangular shape below the top hook. The top hook has an integrated garment spacer wherein the integrated garment spacer is defined as depth greater than the shoulders of the unitary frame body. The top hook provides for the maintaining of space between hung garments by allowing the top hooks of adjacent hangers to touch while preventing contact between the hung garments. The top hook is configured for hanging the garment hanger on the support bar. Each shoulder and top hook have a geometrical cross section defining an upper flange and a lower flange connected by a web. The cross section maintained continuously throughout the shoulders. When multiple garment hangers of the plurality are hung adjacently on the support bar, the integrated garment spacers of adjacent hangers contact each other, creating uniform spacing between hangers. The wider top hooks maintain a predetermined distance between garments hung on adjacent hangers, thereby reducing contact and wrinkling between the garments.

The invention disclosed herein provides a method of organizing garments to promote wrinkle-free storage and an organized appearance. The method comprises providing a support bar for garment hangers to hang and providing a plurality of garment hangers. Each garment hanger comprises a unitary frame body with a pair of shoulders and a top hook, the top hook for engaging with a support bar, thereby forming a structure to support a garment. The step of providing a plurality of garment hangers comprises configuring each pair of shoulders to extend outwardly and angle downwardly from opposite sides of the top hook, thereby forming a triangular shape below the top hook, to support the natural shoulder shape of garments and prevent shoulder bumps. The step of providing a plurality of garment hangers also comprises forming the top hook of each hanger with an integrated garment spacer, the integrated garment spacer having a depth greater than the depth of the pair of shoulders, to maintain space between hung garments by allowing the top hooks of adjacent hangers to touch while preventing contact between the hung garments, thereby reducing wrinkling. The step of providing a plurality of garment hangers also comprises maintaining a continuous geometrical cross section throughout each unitary frame body, the cross section defining an upper flange and a lower flange connected by a web, thereby configuring the frame to form a generally H-shaped profile when viewed in cross-section, to provide reduced weight compared to a solid frame of similar dimensions and improved strength and rigidity. The step of providing a plurality of garment hangers also comprises ensuring the continuous geometrical cross section in each hanger maintains consistent strength and rigidity throughout the entire frame, to provide improved weight distribution for supporting heavier garments without bending or deforming. The step of providing a plurality of garment hangers also comprises including a crossbar in each hanger connecting distal ends of the pair of shoulders, wherein the pair of shoulders form into the distal ends of the crossbar, to provide additional structural support and maintain the shape of the garment hanger under load. The step of providing a plurality of garment hangers also comprises texturing a top surface of each shoulder in each garment hanger, the textured surface including ribs, to reduce slippage of engaged garments by providing a gripping surface, thereby ensuring garments remain securely in place. The step of providing a plurality of garment hangers also comprises providing notches on top sides of the pair of shoulders in each garment hanger for hanging garments with straps, such as tank tops and dresses, to prevent garments from sliding off the hanger and to maintain a neat and organized appearance. The step of providing a plurality of garment hangers also comprises configuring each unitary frame body to be elongated in width beyond a standard garment hanger, approximately 2 inches wider, to prevent bumps in shirt shoulders and accommodate larger garments. The step of providing a plurality of garment hangers also comprises maintaining uniform spacing between hangers when the plurality of garment hangers are hung adjacently on the support bar, wherein the integrated garment spacers of adjacent hangers contact each other, to provide consistent airflow between garments hung on adjacent hangers, thereby reducing the likelihood of moisture build-up and odors. The step of providing a plurality of garment hangers also comprises enhancing overall structural design of each hanger, wherein the continuous geometrical cross section provides reduced weight, increased strength, consistent rigidity, and improved weight distribution, to facilitate the use of the garment hangers for a wide range of garment types, from lightweight fabrics to heavy coats, without compromising the integrity of the hangers or the condition of the garments.

It is an object of the present invention to provide a system that increases the space between garments promoting airflow and minizine garment to garment contact.

It is yet another object of the present invention is to provide a strong but lightweight construction that is capable of securely hanging even the heaviest of garments.

It is yet additionally an object of the present invention to provide a garment hanger having a textured upper interacting surface to prevent slippage of a hanging garment.

It is a further object to provide an integrated solution that incorporates the features into a simple and easily producible apparatus that can be grouped and provided as a system.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
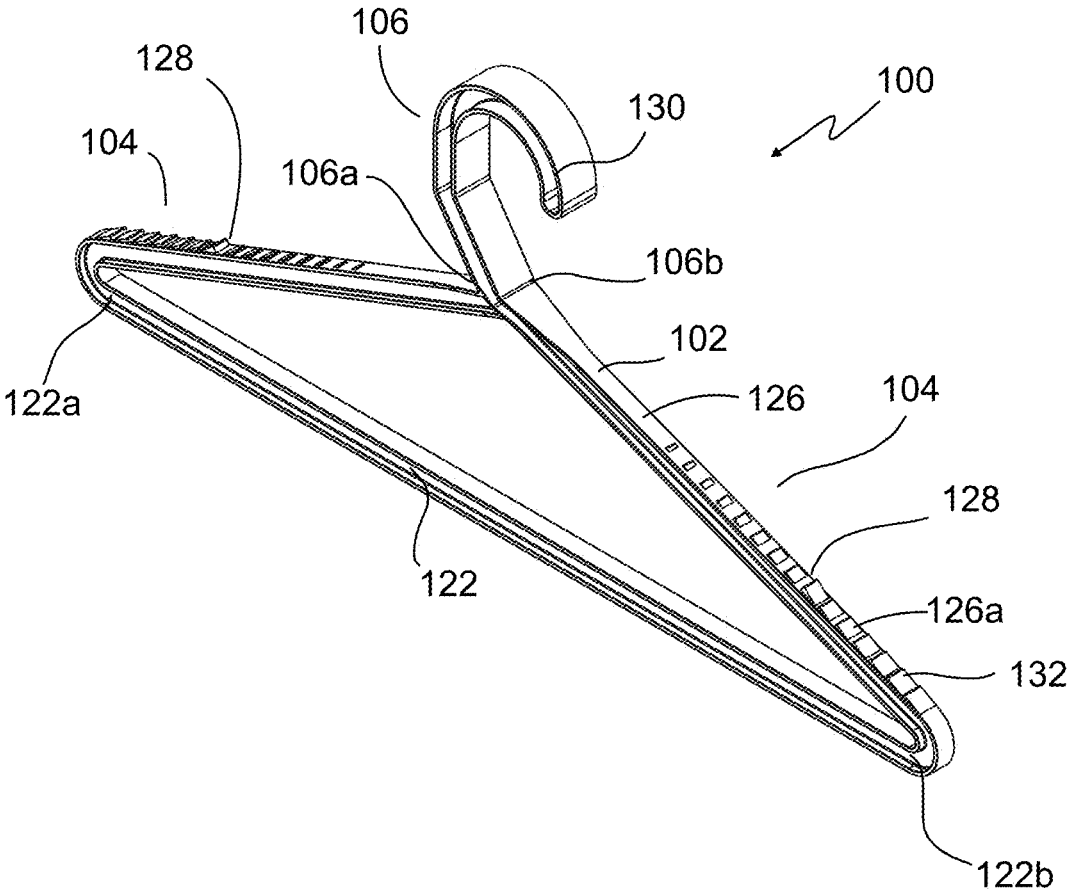
FIG. 1 illustrates an isometric front view of a garment hanger of the present invention.

The present invention, addresses longstanding issues of unorganized storage of garments leading to wrinkles and uneven wearing of hang-stored clothing, and solves these issues through a unique and innovative design. The hanger features a continuous geometrical cross-sectional profile that enhances strength and rigidity while maintaining a lightweight structure. Its wide hook design includes an integrated garment spacer, ensuring uniform spacing between adjacent hangers and preventing garment-to-garment contact. This design minimizes wrinkling and promotes better airflow between garments. The wider shoulders of the hanger provide better support, reducing the occurrence of shoulder bumps. Additionally, the hanger incorporates an anti-slippage textured surface and notches for secure hanging of various garment types. These features collectively offer a comprehensive solution for maintaining garment quality, enhancing closet organization, and improving the overall storage experience.

Hangers are essential tools for garment storage and display, used in homes, retail stores, and professional garment care settings. They come in various designs, each tailored to specific types of clothing or storage needs. Hangers are typically made from wood, plastic, metal, or a combination of these materials. Wooden hangers, often crafted from cedar, maple, or beech, are prized for their durability and ability to repel moths. Plastic hangers are lightweight, affordable, and come in various colors, making them popular for home use. Metal hangers, usually made from steel or aluminum, are known for their strength and slim profile, making them a common choice in commercial settings.

The dimensions of hangers can vary based on their intended use, but standard hangers generally fall within specific ranges. Adult-sized hangers typically measure 17-19 inches (43-48 cm) in width, while children's sizes are usually 12-14 inches (30-36 cm) wide. The height from the top of the hook to the bottom of the hanger is typically 8-9 inches (20-23 cm), with the hook itself measuring 2-3 inches (5-8 cm) in height. Hanger thickness can depend on the material and design. Specialty hangers, such as those for suits or coats, may be wider, typically ranging from 19-24 inches (48-61 cm) to accommodate broader shoulders and heavier garments.

Most hangers feature a triangular shape that mimics the human shoulders. This design helps maintain the shape of garments and distribute weight evenly. However, variations exist, including curved hangers with a gentle slope that better matches the natural curve of human shoulders, straight hangers often used for pants or skirts with a horizontal bar for draping garments, and clip hangers that have clips or clamps attached for hanging pants, skirts, or other items that can't be easily draped.

A typical hanger consists of several key parts. The hook at the top is used to hang the hanger on a rod or bar and is usually made of metal, even in wooden or plastic hangers, for durability. The shoulder is the wide, often slightly curved part that supports the shoulders of a garment. Arms extend from the shoulders, supporting the body of the garment. Some designs include a crossbar, a horizontal bar that connects the two arms, useful for draping pants or providing additional support. Many hangers have a cutout on the shoulders, called notches, to hold strapped garments in place.

Beyond the standard designs, there are numerous specialized hangers. Suit hangers often have a crossbar for pants. Padded hangers feature soft padding on the shoulders to protect delicate fabrics. Cascading hooks allow multiple hangers to be hung vertically, saving space. Folding travel hangers offer collapsible designs for easy packing. Tie and belt racks feature multiple arms or hooks for organizing accessories.

The design and choice of hanger can significantly impact garment care. Proper hangers can help maintain the shape of clothes, prevent stretching and distortion, and maximize closet space. As a result, hanger design continues to evolve, with innovations aimed at addressing common storage issues and meeting the diverse needs of consumers and businesses alike. This ongoing evolution in hanger design reflects the importance of these seemingly simple devices in our daily lives and in the broader context of garment care and storage.

As stated above, garment hangers have been a fundamental tool in clothing storage for over a century, with designs evolving to meet the needs of both domestic and commercial users. Traditional hangers are typically made from materials such as wood, wire, or plastic and are designed to maximize the vertical space in closets. Despite their widespread use, conventional hanger designs have remained relatively unchanged over the years, with most innovations focusing on increasing storage capacity or improving portability. While these innovations address some aspects of garment storage, they often fail to tackle persistent issues such as garment wrinkling, shoulder deformities, and slippage.

Current garment hangers include wire, plastic, and wooden designs with various shapes and features. Typically, these hangers support garments by draping them over a horizontal bar or shoulders, with some designs incorporating additional elements like clips or bars for pants. However, existing hangers often contribute to garment wrinkling, create shoulder bumps in clothing, allow garments to slide off, and fail to maintain consistent spacing between hung items.

Traditional hangers often lead to several common problems that compromise garment care and closet organization. One significant issue is wrinkling, which occurs when garments are compressed against each other due to the narrow profile of typical hangers. This compression not only creates creases in fabrics but also limits airflow between garments, which can lead to moisture build-up and unpleasant odors. Another prevalent issue is the formation of shoulder bumps, particularly in larger shirts and jackets. These deformations result from inadequate support along the shoulder line, where narrow or sharply angled hangers create pressure points. Additionally, many traditional hangers lack features to prevent slippage, causing garments to slide off and end up disorganized or on the floor.

The need for an improved hanger design is evident from the limitations of existing solutions. Consumers seek hangers that not only support a variety of garment types but also enhance the overall appearance and organization of their closets. There is a demand for hangers that provide adequate spacing between garments to prevent wrinkling, maintain the natural shape of garments to avoid shoulder bumps, and offer features that secure clothes in place to prevent slippage. Furthermore, these improvements should not compromise the structural integrity of the hanger, as it must be capable of supporting heavier garments without bending or breaking. The ideal hanger design would address all these issues while being easy to use and maintain.

The current invention solves various problems by providing a garment hanger and associated garment hanger system that provides a system increasing the space between garments promoting airflow and minimizing garment to garment contact, provides a strong but lightweight construction that is capable of securely hanging even the heaviest of garments, provides a garment hanger having a textured upper interacting surface to prevent slippage of a hanging garment, and provides an integrated solution that incorporates the features into a simple and easily producible apparatus that can be grouped and provided as a system.

The invention herein includes a uniquely configured garment hanger with spacing means, and enhanced geometry capable of solving the above issues, as well as a system and method thereof.

The most critical feature of this new hanger design is its integrated garment spacer. The hook of each hanger incorporates this spacer, designed with a width greater than the rest of the frame. This wider hook serves a dual purpose: it creates uniform spacing between adjacent hangers when hung on a rod, and it maintains a predetermined distance between garments.

For example, in some embodiments, the hook that goes over the clothes rod is ¾" wide and the rest of the hanger is ⅜" wide so the top part of the hanger—the hook touches and it—allows clothes to hang wrinkle free and all hangers touch on clothes rod so closet looks neat and organized. This spacing mechanism is integrated into the geometry of the hanger.

This spacing mechanism is crucial in preventing garment-to-garment contact, a primary cause of wrinkling during storage. The uniform spacing not only helps in maintaining the aesthetic appeal of an organized closet but also facilitates better airflow, which can help in moisture management and odor prevention.

The spacing feature also makes it easier to see and access individual garments in a crowded closet. With traditional hangers, clothes often bunch together, making it difficult to find specific items without disturbing the entire contents of the closet. The uniform spacing provided by these new hangers allows for easier visual scanning and physical access to individual garments, saving time and reducing frustration during the daily process of selecting outfits.

In commercial laundry and dry-cleaning settings, the spacing feature can offer significant benefits. The ability to prevent wrinkles and maintain garment shape during storage and transport can reduce the need for re-pressing or touch-ups, potentially streamlining operations and reducing labor costs.

The uniform spacing created by these hangers can also contribute to more efficient use of closet space. By maintaining consistent distances between garments, it becomes easier to maximize the number of items that can be stored in a given area without overcrowding. This could be particularly beneficial in small living spaces where storage is at a premium.

At the core of this new hanger's design is a unique cross-sectional profile that runs continuously throughout the hanger frame. This profile, reminiscent of an I-beam or H-beam in structural engineering, consists of an upper flange, a lower flange, and a connecting web. This configuration provides several advantages over traditional solid or hollow hanger designs.

The continuous beam-like structure significantly enhances the hanger's strength-to-weight ratio. By distributing material efficiently, the hanger achieves superior rigidity and load-bearing capacity while maintaining a lightweight profile. This is particularly beneficial for heavier garments, which often cause traditional hangers to bend or deform over time.

The hanger's shoulders and arms, which form part of the triangular frame, maintain the same cross-sectional profile as the hook. This consistency in design ensures that the strength and weight distribution benefits extend throughout the entire hanger structure. The geometrical cross-section not only provides strength and rigidity but also helps in reducing the overall weight of the hanger, making it easy to handle and less likely to cause deformation in lightweight fabrics.

The continuous cross-sectional profile of the hanger ensures that the load is evenly distributed across the entire frame. This uniform distribution of weight prevents localized stress points that can lead to deformation or breakage. The hanger's design also minimizes the pressure points on the garment, reducing the likelihood of fabric damage or wear.

The engineering behind this new hanger is rooted in the principles of structural efficiency and material optimization. By employing a continuous geometrical cross-section, similar to the design principles used in structural beams, the hanger achieves a balance between strength and weight. This design choice allows the hanger to support a wide range of garments, from delicate dresses to heavy coats, without compromising its structural integrity.

The choice of materials is critical in achieving the desired strength-to-weight ratio. The new hanger is typically made from high-strength, lightweight materials such as reinforced plastics or composite materials. These materials offer durability and flexibility, ensuring that the hanger can withstand regular use without breaking or deforming. Additionally, the use of environmentally friendly materials can be considered, aligning with the growing demand for sustainable products.

The production of these new hangers can be optimized through modern manufacturing techniques such as injection molding or 3D printing. These methods allow for precise control over the hanger's dimensions and material properties, ensuring consistent quality and performance. Additionally, the use of automated production processes can reduce manufacturing costs and increase scalability, making this new hanger a viable option for both mass production and custom applications.

The hanger is designed to be 2 inches wider than standard hangers, providing better support for the natural shape of the garment's shoulder. This increased width distributes the weight of the garment over a larger surface area, reducing the likelihood of creating shoulder bumps. The wider shoulders are especially important for larger garments, such as jackets, coats, and sweaters, which are more prone to shoulder deformation.

The top sides of the hanger's shoulders feature a textured surface, often in the form of a scale-like rib pattern. This texture increases the friction between the hanger and the garment, preventing clothes from sliding off. The anti-slippage feature is particularly useful for garments with narrow straps, such as tank tops or dresses, which are prone to slipping off traditional hangers. The textured surface ensures that garments remain securely in place, reducing the need for constant readjustment.

For added versatility, the new hanger incorporates notches on the top sides of the shoulders. These notches provide secure anchor points for hanging garments with straps, such as tank tops or dresses. The inclusion of notches addresses a common limitation of standard hangers, which often fail to securely hold strap garments, leading to slippage and disorganization.

This new hanger stands out in the market due to its unique combination of features that address multiple garment storage issues simultaneously. Unlike other hangers that focus on a single aspect of garment storage, such as space-saving or portability, this hanger provides a comprehensive solution that enhances both functionality and aesthetics.

The innovative hanger represents a significant advancement in garment hanger technology, addressing the longstanding issues of wrinkling, shoulder bumps, and slippage. By providing a well-thought-out design that balances functionality, durability, and aesthetics, this hanger offers a superior solution for garment storage. Its innovative features not only enhance the appearance of the closet but also contribute to the longevity and maintenance of the garments it supports. This invention aligns with the growing consumer demand for products that offer practical benefits while improving the overall organization and appearance of living spaces.

The garment hanger with integrated spacing mechanism for wrinkle-free storage of the present invention may be used to provide a system capable of increasing the space between garments promoting airflow and minimizing garment to garment contact, provide a strong but lightweight construction that is capable of securely hanging even the heaviest of garments, provide a garment hanger having a textured upper interacting surface to prevent slippage of a hanging garment, and provide an integrated solution that incorporates the features into a simple and easily producible apparatus that can be grouped and provided as a system. This apparatus and system are particularly shown in FIGS. 1-11, wherein, as depicted in FIGS. 1-3 and 10A-10D, the top hook including the integrated garment spacer (i.e., the hook-shaped garment spacer) defines a monolithically integrated geometry providing spacing between adjacent hangers.

FIG. 1 illustrates an isometric front view of a garment hanger 100 of the present invention. The hanger comprises a unitary frame body 102 with a pair of shoulders 104 extending outwardly and angling downwardly from a top hook 106. The top hook 106 features opposite sides 106*a*, 106*b* and contact surfaces 130 for spacing. A crossbar 122 connects the distal ends 122*a*, 122*b* of the shoulders 104. The top surface 126 of the shoulders 104 includes an integral textured area 132 with ribs 126*a* for grip. Notches 128 are provided on the shoulders 104 for hanging strapped garments.

Figure 2:
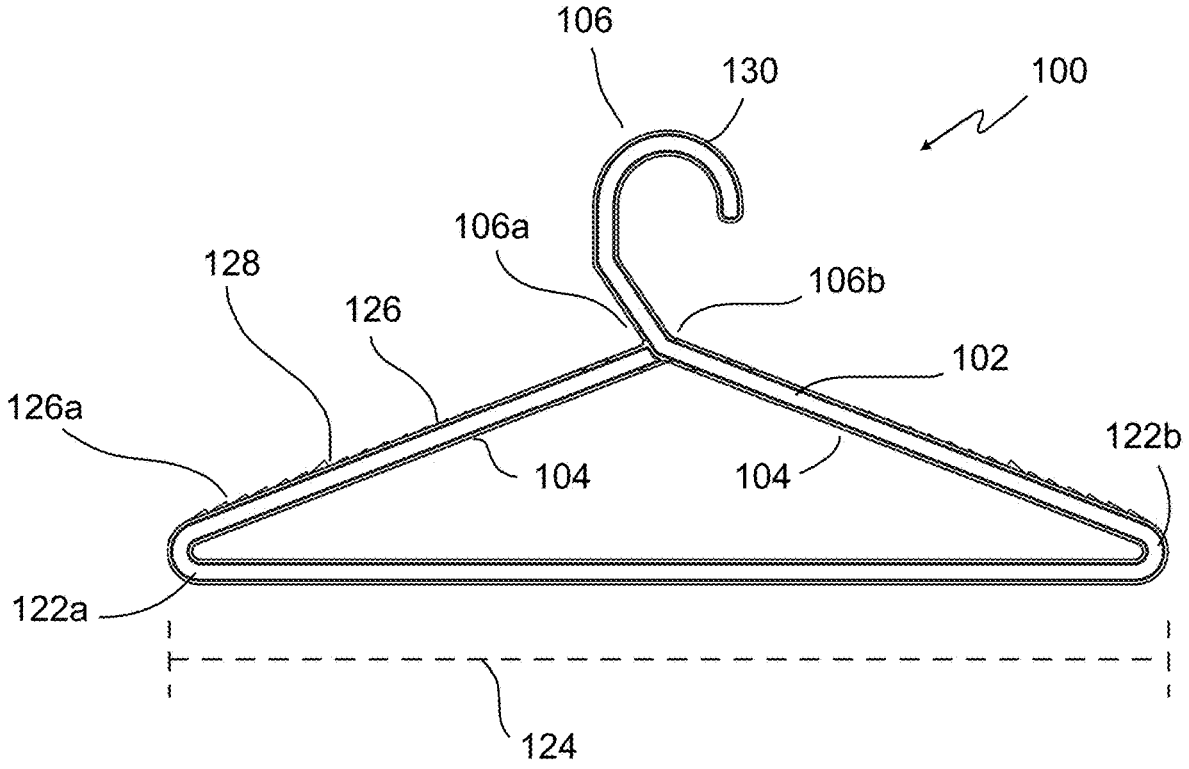
FIG. 2 illustrates a side view of the garment hanger of the present invention.

FIG. 2 illustrates a side view of the garment hanger 100. This view highlights the profile of the top hook 106 with its contact surface 130, and the side of the shoulder 104. The width 124 of the frame body 102 is shown. The textured top surface 126 with ribs 126*a* and notches 128 are visible, as are the ends of the crossbar 122*a*, 122*b*, forming into the lower ends of the shoulders 104.

Figure 3:
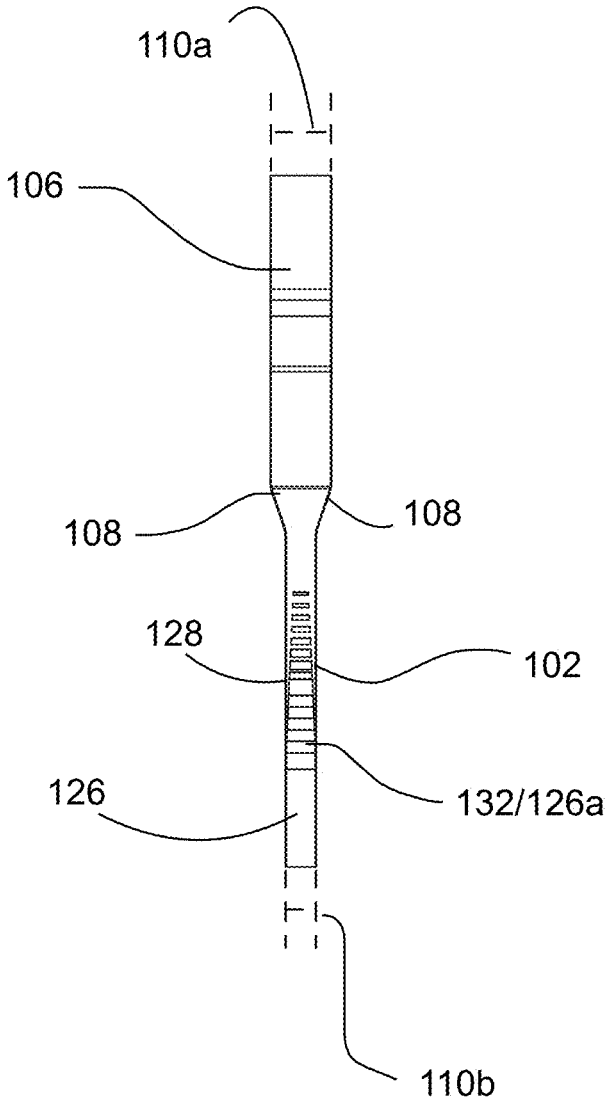
FIG. 3 illustrates a rear view of the garment hanger of the present invention.

FIG. 3 illustrates a rear view of the garment hanger 100. This perspective showcases the top hook 106 with its integrated garment spacer 108, emphasizing the greater depth 110*a* of the hook compared to the depth 110*b* of the shoulders. The textured area 132 with ribs 126*a* on the top surface 126 of the frame body 102 is clearly visible.

Figure 4:
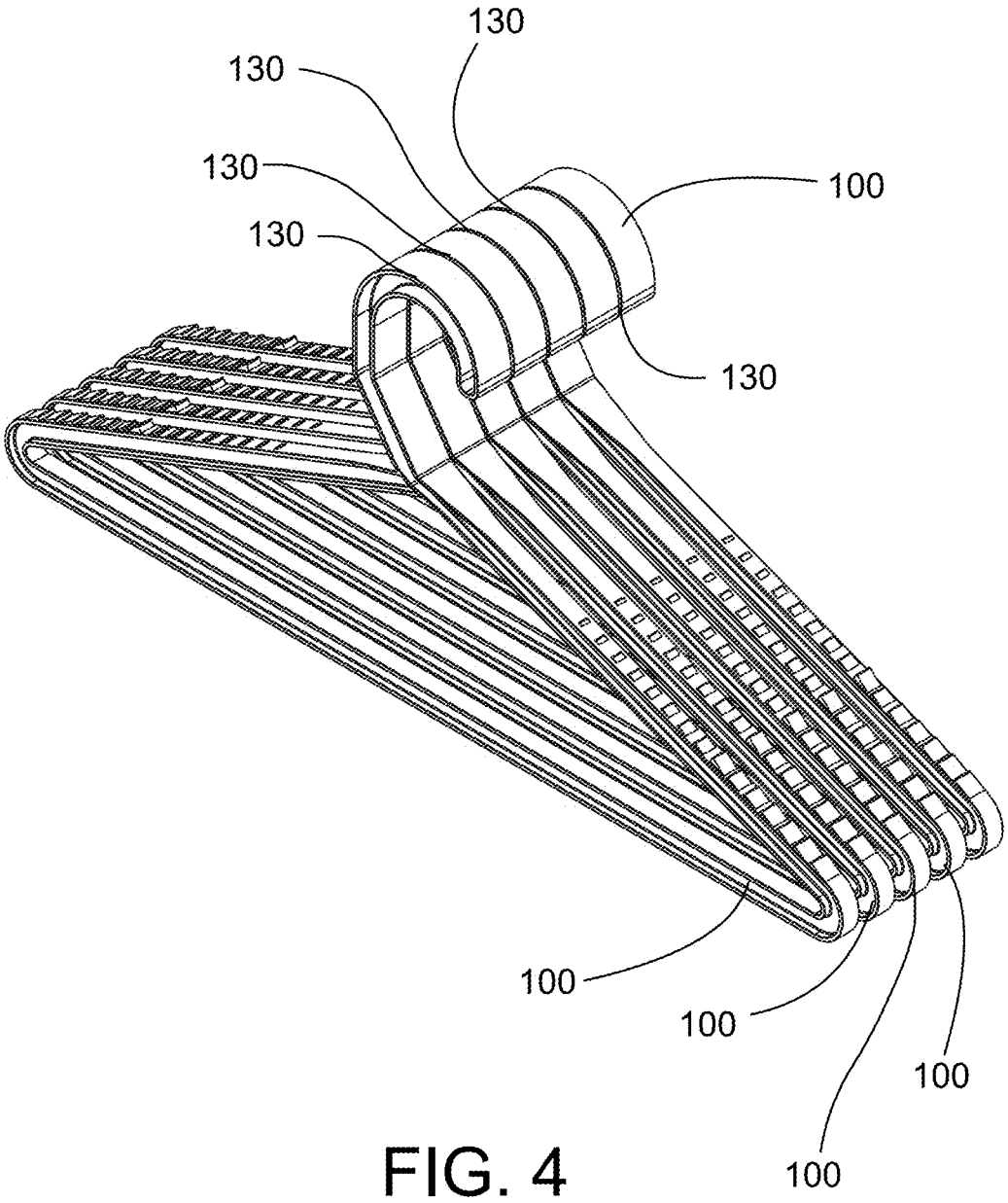
FIG. 4 illustrates an isometric front view of several garment hangers of the garment hanger system.

FIG. 4 illustrates an isometric front view of several garment hangers 100 of the garment hanger system. This view emphasizes how the contact surfaces 130 of adjacent hangers 100 interact to maintain consistent spacing between hangers 100.

Figure 5:
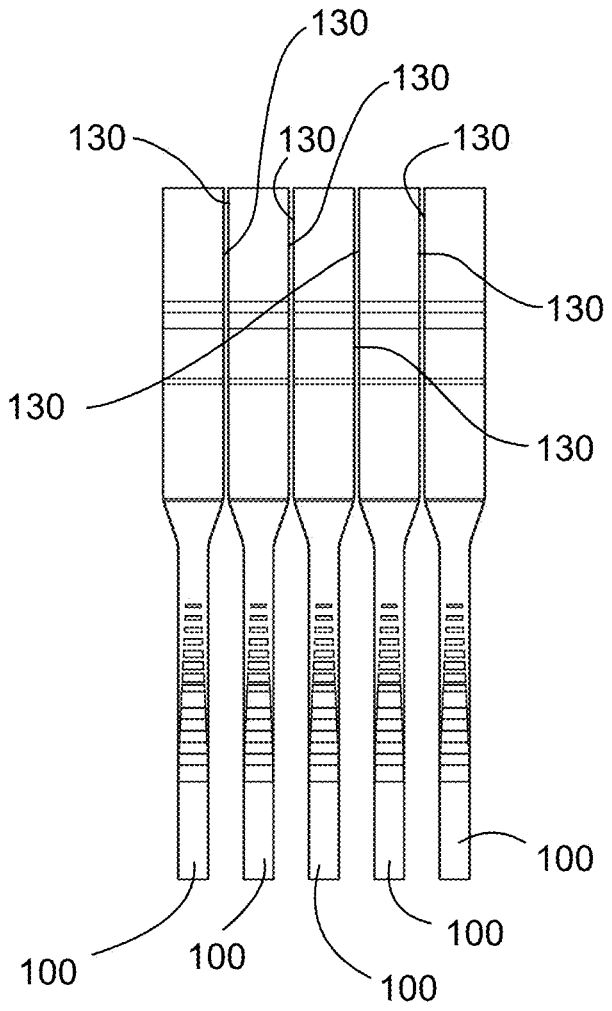
FIG. 5 illustrates a rear view of several garment hangers of the garment hanger system.

FIG. 5 illustrates a rear view of several garment hangers 100 of the garment hanger system. Similar to FIG. 4, this view shows how the contact surfaces 130 of adjacent hangers 100 create uniform spacing from the rear perspective.

Figure 6:
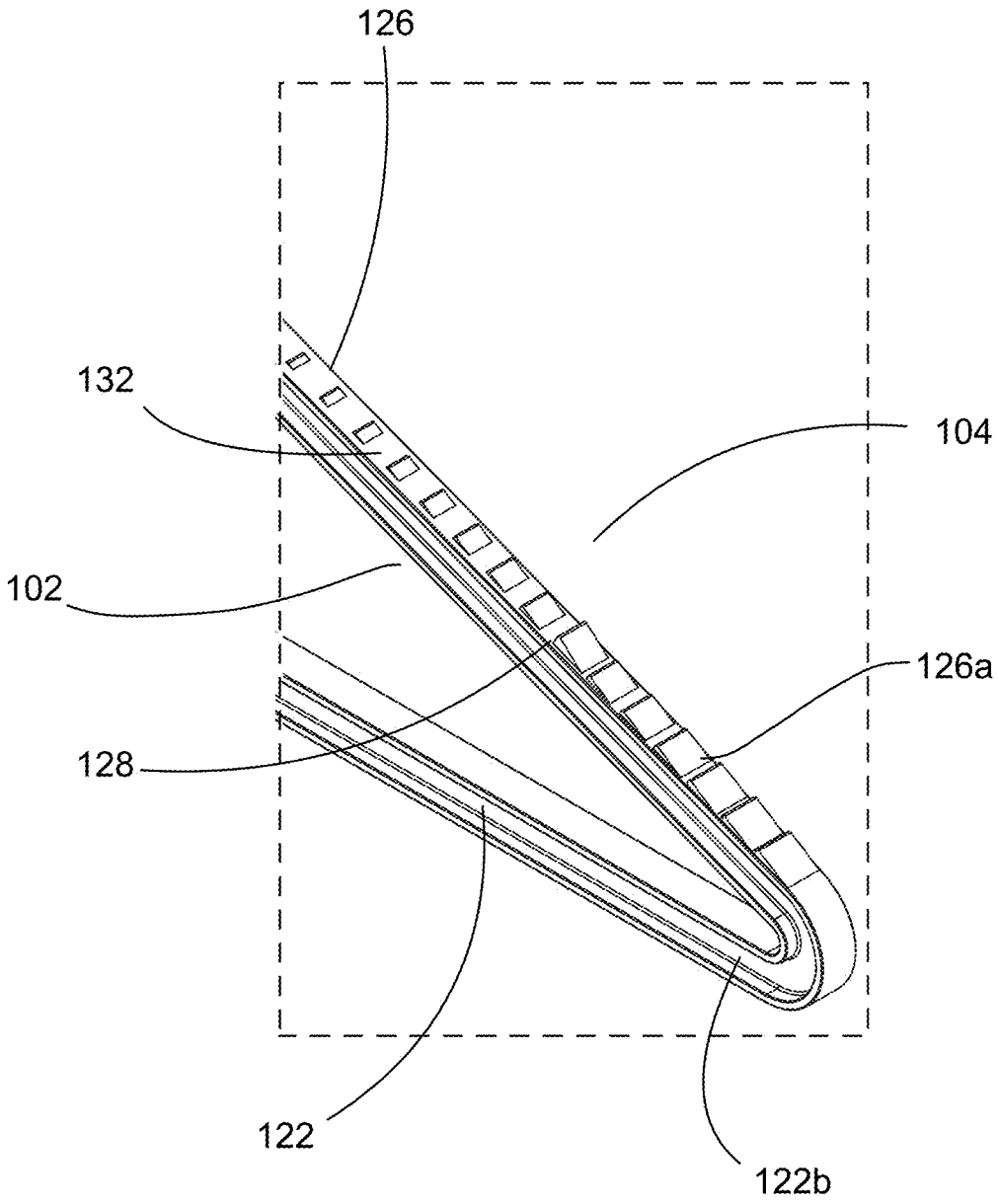
FIG. 6 illustrates an enlarged view of the corner of a garment hanger in the garment hanger system, showing the textured upper surface.

FIG. 6 illustrates an enlarged view of the corner of the frame body 102 of a garment hanger 100 in the garment hanger system, showing the textured upper surface 126. This detailed view highlights the junction of the shoulder 104 and crossbar 122, showcasing the textured area 132 on the top surface 126, the notch 128, ribs 126*a*, and the transition to the distal end 122*b* of the crossbar.

Figure 7:
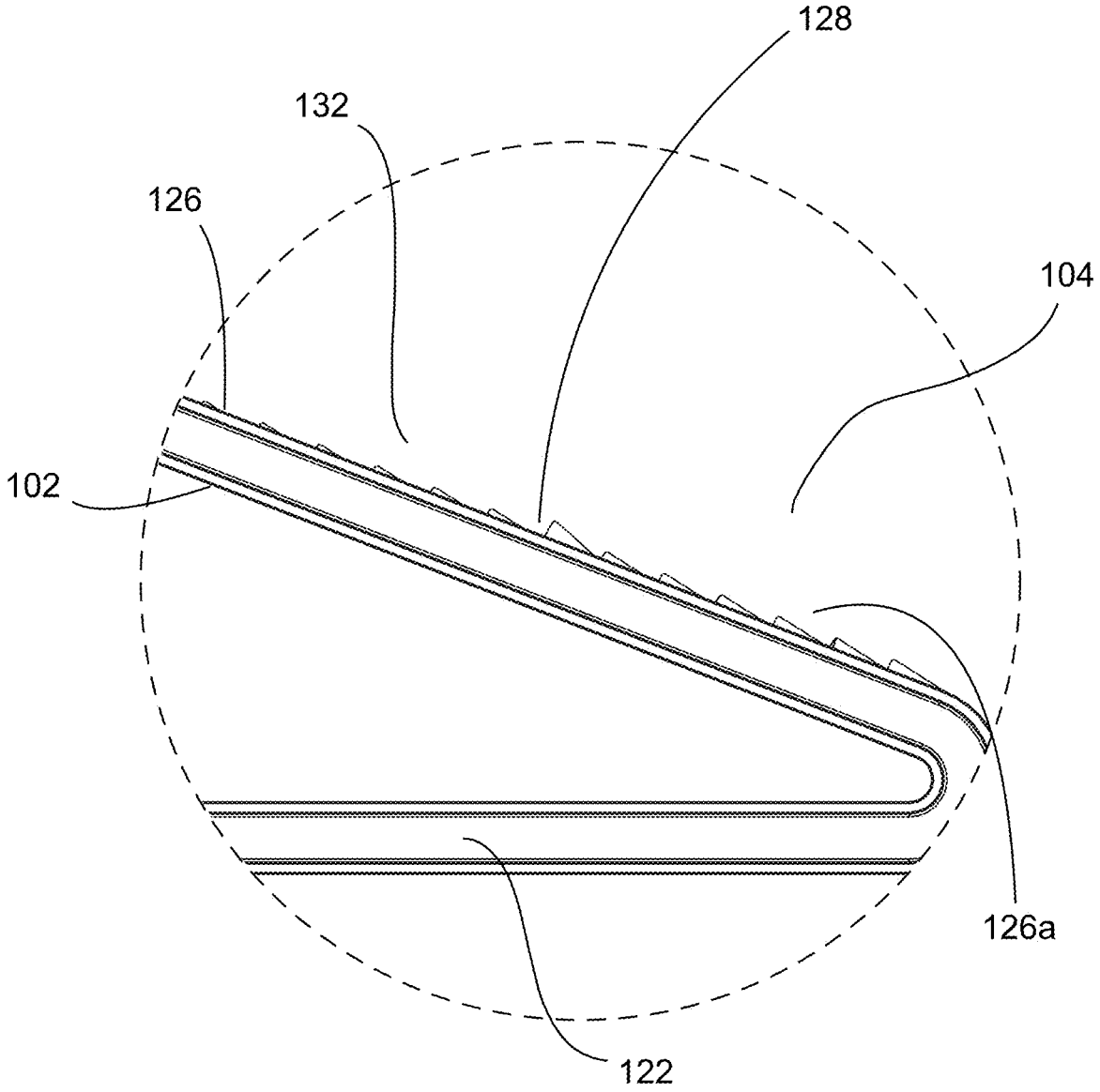
FIG. 7 illustrates a side view of the enlarged view shown in FIG. 6.

FIG. 7 illustrates a side view of the enlarged view shown in FIG. 6. This perspective provides a clear view of the shoulder 104 profile, the textured area 132 with ribs 126*a* on the top surface 126, the notch 128, ribs 126*a*, and how these elements integrate with the frame body 102 and crossbar 122.

Figure 8:
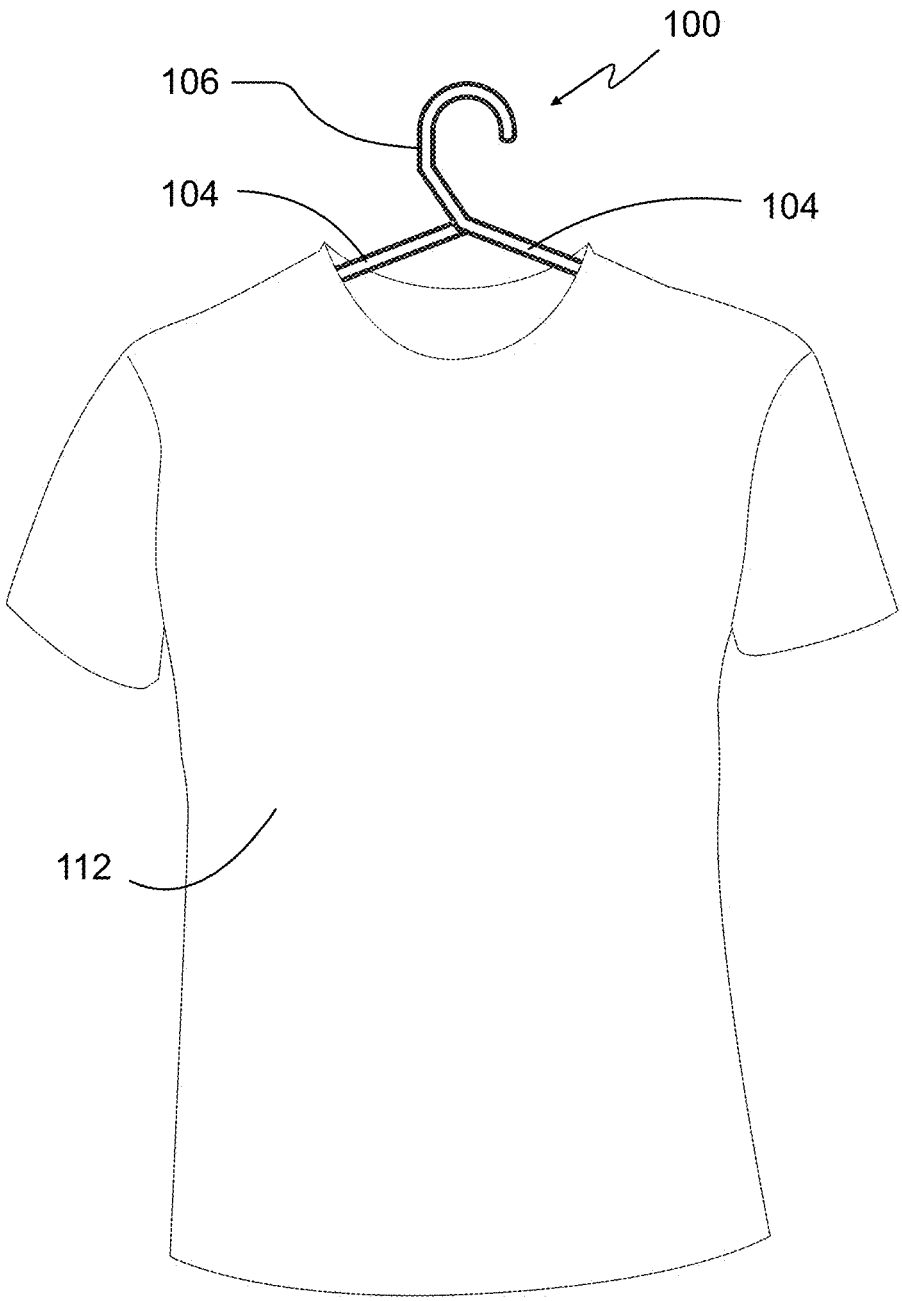
FIG. 8 illustrates a garment hanger with a shirt draped over it.

FIG. 8 illustrates a garment hanger 100 with a shirt 112 draped over it. This figure demonstrates how the shoulders 104 support the garment, preventing shoulder bumps and maintaining the garment's shape. FIG. 8 also shows the top hook 106 connecting to the shoulders 104.

Figure 9:
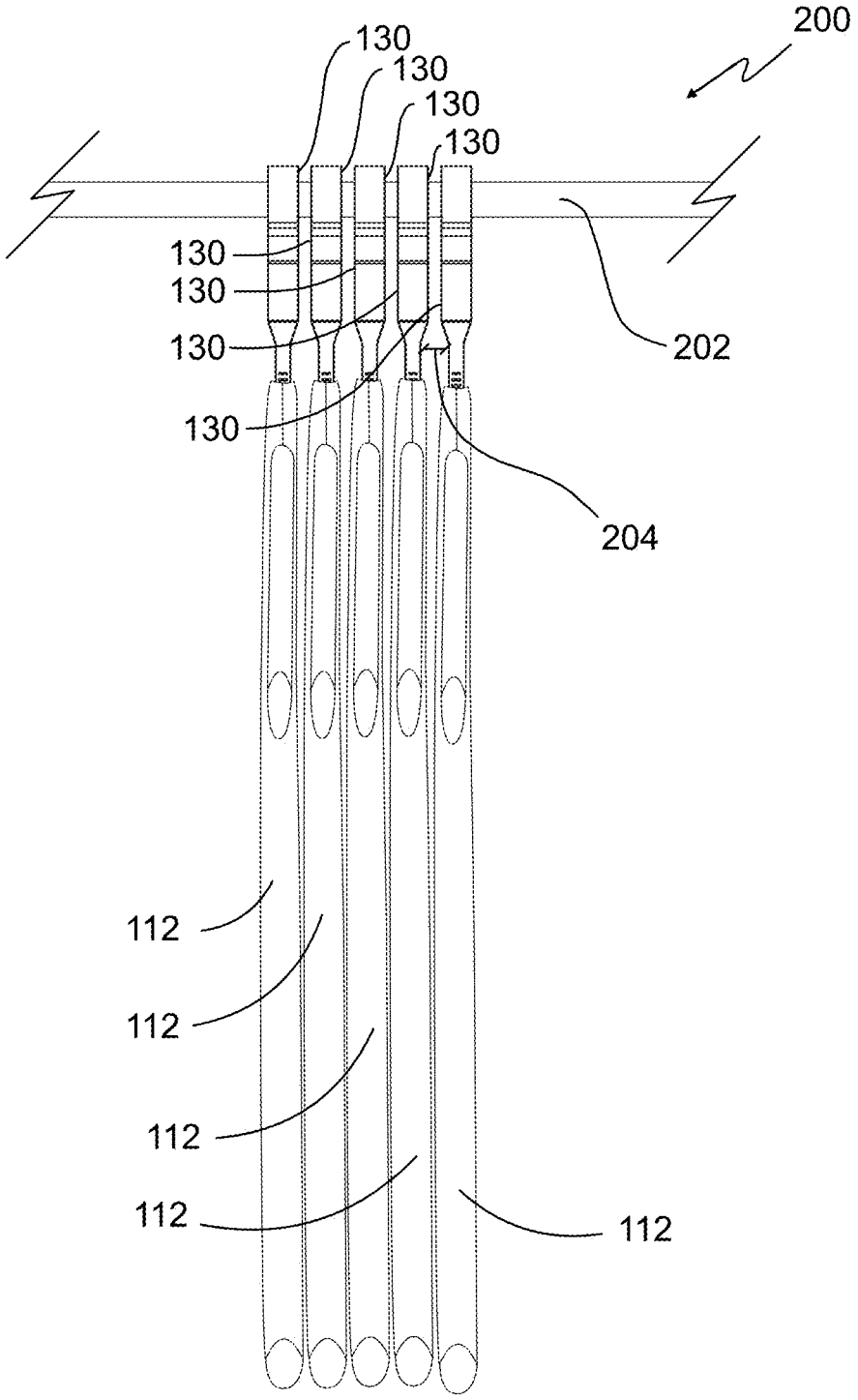
FIG. 9 illustrates a rear view of several garment hangers of the garment hanger system, each with a garment draped over it, hanging on a closet rod.

FIG. 9 illustrates a rear view of several garment hangers 100 of the garment hanger system 200, each with a garment 112 draped over it, hanging on a closet rod 202. This view showcases how the contact surfaces 130 maintain a predetermined distance 204 between adjacent garments, promoting wrinkle-free storage.

Figure 10A:
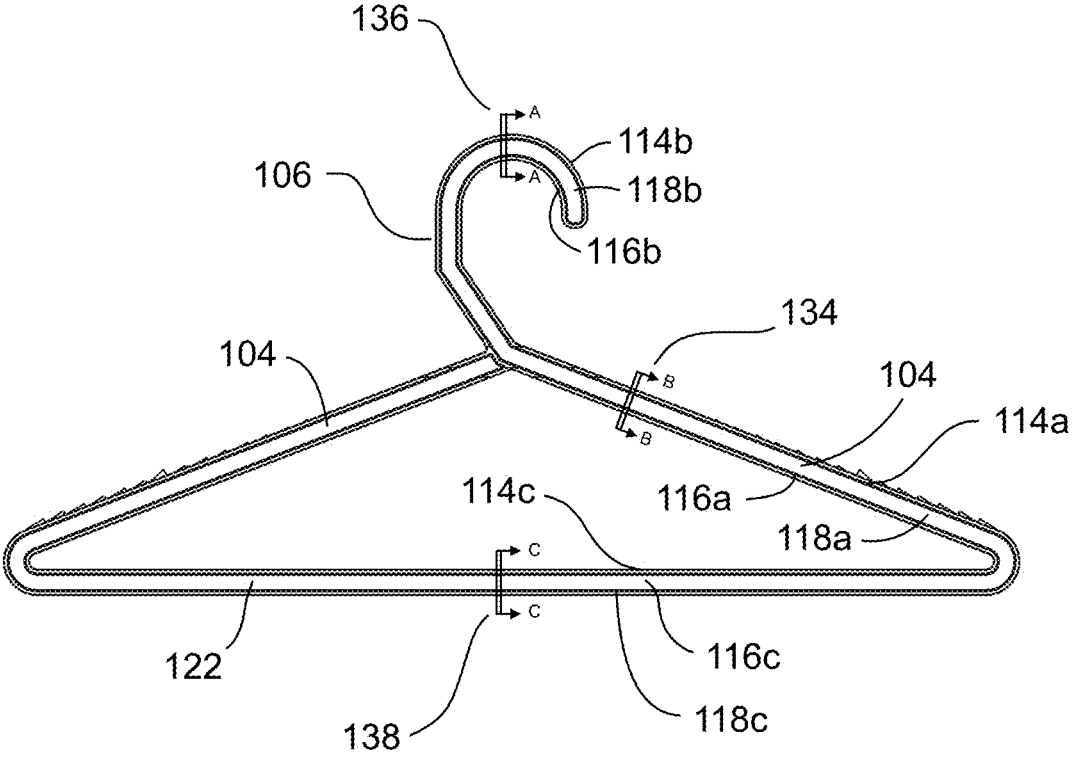
FIG. 10A illustrates a side view of the garment hanger of the present invention with section cuts A-A, B-B, and C-C.

FIG. 10A illustrates a side view of the garment hanger 100 with section cuts A-A 136, B-B 134, and C-C 138. These cuts show the locations where cross-sectional views are taken to illustrate the H-shaped profile of the top hook 106, shoulders 104, and crossbar 122. The figure also depicts the continuous geometrical cross-section throughout the hanger, showing the upper flanges 114*a*, 114*b*, 114*c*, lower flanges 116*a*, 116*b*, 116*c*, and connecting webs 118*a*, 118*b*, 118*c*, for the shoulder 104, top hook 106, and crossbar 122 respectively. This view emphasizes how the H-shaped profile is maintained consistently across different parts of the hanger, contributing to its overall strength and lightweight design.

Figure 10B:
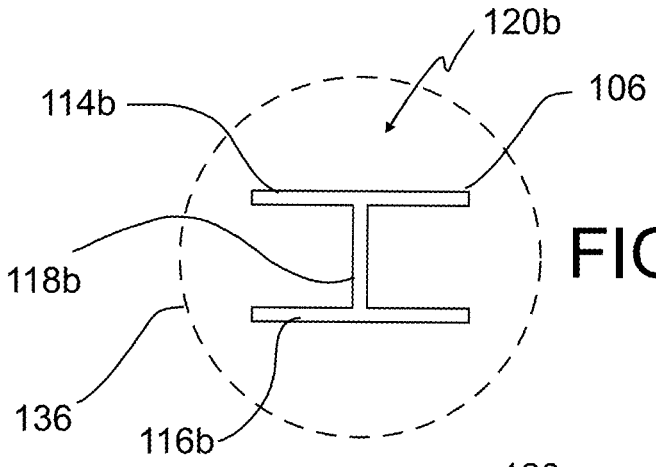
FIG. 10B illustrates the cross-sectional structure of the top hook at section cut A-A.

FIG. 10B illustrates the cross-sectional structure of the top hook 106 at section cut A-A 136. This view shows the H-shaped profile 120*b* formed by the upper flange 114*b*, lower flange 116*b*, and connecting web 118*b* of the top hook 106.

Figure 10C:
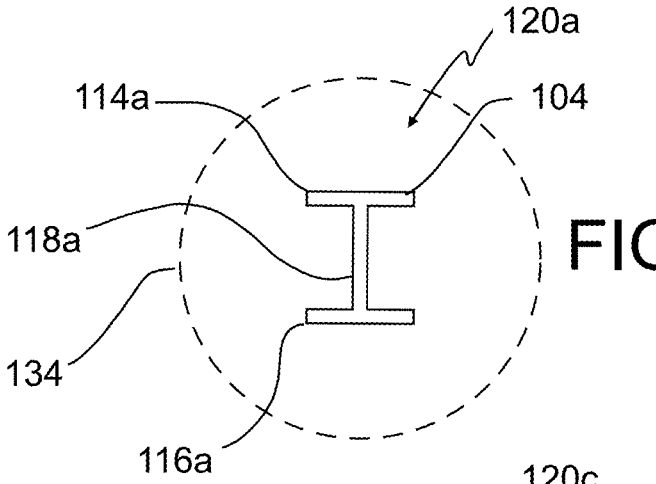
FIG. 10C illustrates the cross-sectional structure of the shoulder at section cut B-B.

FIG. 10C illustrates the cross-sectional structure of the shoulder 104 at section cut B-B 134. This view demonstrates the H-shaped profile 120*a* of the shoulder 104, formed by the upper flange 114*a*, lower flange 116*a*, and connecting web 118*a*.

Figure 10D:
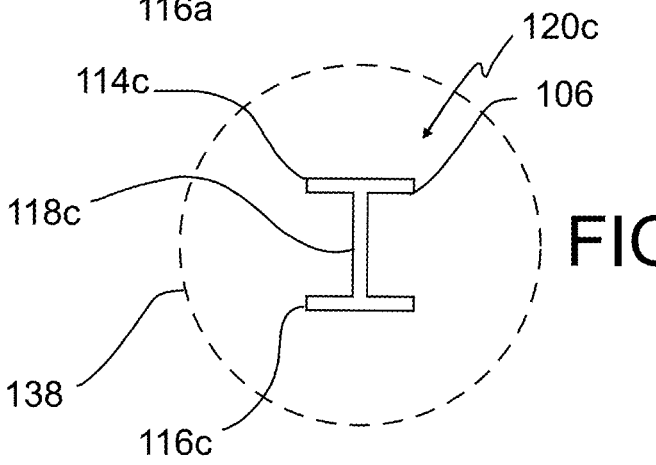
FIG. 10D illustrates the cross-sectional structure of the top hook at section cut C-C.

FIG. 10D illustrates the cross-sectional structure of the crossbar at section cut C-C 138. This view shows the H-shaped profile 120*c* of the crossbar 122, formed by the upper flange 114*c*, lower flange 116*c*, and connecting web 118*c*.

Figure 11:
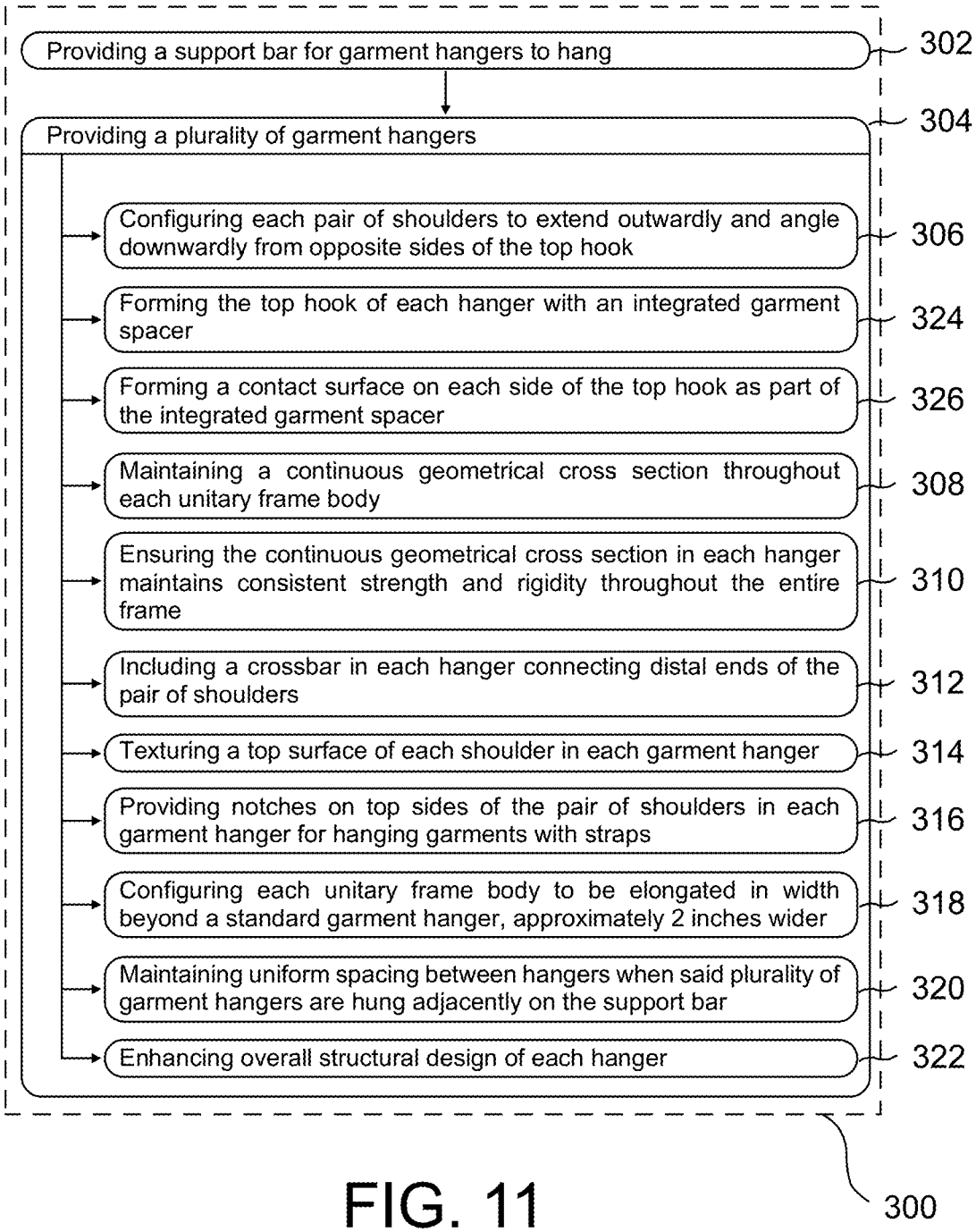
FIG. 11 illustrates a flow chart of a method of organizing garments to promote wrinkle-free storage and an organized appearance.

FIG. 11 illustrates a flow chart of a method 300 of organizing garments 112 to promote wrinkle-free storage and an organized appearance. The chart outlines the primary steps: providing 302 a support bar 202 for garment hangers 100 to hang, and providing 304 a plurality of garment hangers 100. The step of providing 304 a plurality of garment hangers 100 also includes the steps of: configuring 306 each pair of shoulders 104 to extend outwardly and angle downwardly from opposite sides of the top hook 106; forming 324 the top hook 106 of each hanger 100 with an integrated garment spacer 108; forming 326 a contact surface 130 on each side of the top hook 106 as part of the integrated garment spacer 108; maintaining 308 a continuous geometrical cross section throughout each unitary frame body 102; ensuring 310 the continuous geometrical cross section in each hanger 100 maintains consistent strength and rigidity throughout the entire frame 102; including 312 a crossbar 122 in each hanger 100 connecting distal ends 122*a*/122*b* of the pair of shoulders 104; texturing 314 a top surface 126 of each shoulder 104 in each garment hanger 100; providing 316 notches 128 on top sides 126 of the pair of shoulders 104 in each garment hanger 100 for hanging garments 112 with straps; configuring 318 each unitary frame body 102 to be elongated in width 124 beyond a standard garment hanger, approximately 2 inches wider; maintaining 320 uniform spacing between hangers 100 when said plurality of garment hangers 100 are hung adjacently on the support bar 202; and enhancing 322 the overall structural design of each hanger 100. This flowchart provides a comprehensive overview of the method for implementing the innovative garment hanger system.

In an exemplary embodiment, shown in FIGS. 1-8 and 10A-10D, a garment hanger 100 for promoting wrinkle-free storage and organization is disclosed. The garment hanger 100 comprises a unitary frame body 102 comprising shoulders 104 and a top hook 106 for engaging with a support bar. The pair of shoulders 104 extending outwardly and angled downwardly from opposite sides 106*a*/106*b* of the top hook 106, thereby forming a triangular shape below the top hook 106. The top hook 106 includes an integrated garment spacer 108 wherein the integrated garment spacer 108 is defined as depth 110*a* greater than the depth 110*b* of the pair of shoulders 104, whereby the top hook 106 provides for the maintaining of space between hung garments 112 by allowing the top hooks 106 of adjacent hangers 100 to touch while preventing contact between the hung garments 112. In this regard, the top hook and integrated garment spacer together define a monolithically integrated geometry, forming a single continuous structure.

In some embodiments, the top hook 106 further comprises a contact surface 130 on each side of the top hook 106. The contact surface 130 is configured to abut against contact surfaces of adjacent hangers 100 when multiple hangers 100 are arranged on a support bar 202. This configuration allows the contact surfaces 130 of adjacent hangers 100 to touch while maintaining the predetermined space between hung garments 112, even when the hooks 106 are arranged surface to surface. The contact surface 130 may be flat or slightly curved to ensure consistent contact and spacing between adjacent hangers 100.

In some embodiments, each shoulder 104 in said pair of shoulders 104 comprise a geometrical cross section defining an upper flange 114*a* and a lower flange 116*a* connected by a web 118*a*, said cross section maintained continuously throughout the shoulders 104, wherein the upper flange 114, web 118, and lower flange 116 form a generally H-shaped profile 120*a* when viewed in cross-section, as may be seen in FIG. ##.

In some embodiments, the top hook 106 comprises a geometrical cross section defining an upper flange 114*b* and a lower flange 116*b* connected by a web 118*b*, said cross-section maintained continuously throughout the top hook 106, wherein the upper flange 114*b*, web 118*b*, and lower flange 116*b* form a generally H-shaped profile 120*b* when viewed in cross-section, as may be seen in FIG. ##.

In some embodiments, the garment hanger 100 further comprises a crossbar 122 having distal ends 122*a*/122*b*.The pair of shoulders 104 form into the distal ends 122*a*/122*b* of the crossbar 122, which may be appreciated in FIG. ##, showing the shoulders 104 curving into the crossbar 122.

In some embodiments, the crossbar 122 comprises a geometrical cross section defining an upper flange 114*c* and a lower flange 116*c* connected by a web 118*c*, said cross-section maintained continuously throughout the crossbar 122, wherein the upper flange 114*c*, web 118*c*, and lower flange 116*c* form a generally H-shaped profile 120*c* when viewed in cross-section, as may be seen in FIG. ##.

In some embodiments, a width 124 said frame body 102 is elongated beyond a standard garment hanger to prevent garments 112 from sliding off of the frame body 102. In some embodiments, the width 124 of said frame body is approximately 2 inches wider than a standard hanger to prevent bumps in shirt shoulders.

In some embodiments, a top surface 126 of each shoulder 104 of each garment hanger 100 includes an integral textured area 132 configured to reduce slippage of an engaged garment 112 by providing a gripping top surface 126. In some embodiments top surface 126 includes ribs 126*a*.

In some embodiments, the top hook 106 is ¾ inches wide and the shoulders 104 are ⅜ inches wide, thereby defining the spacer 108 as a depth 110*a* of the top hook 106 which is greater than the depth 110*b* of the shoulders 104. In these embodiments, the top hook 106 provides for the maintaining of space between hung garments 112 by allowing the contact surfaces 130 of the top hooks 106 of adjacent hangers 100 to touch while preventing contact between the hung garments 112.

In some embodiments, each hanger further comprises notches 128 on top surfaces 126 of the pair of shoulders for hanging tank tops and garments 112 that are thin.

In another exemplary embodiment, as may be appreciated in FIGS. 1-10D, a garment hanging system 200 for maintaining organized and wrinkle-free storage of multiple garments is disclosed. The system comprises a support bar 202 and a plurality of garment hangers 100. The garment hangers 100 are configured to hang on the support bar 202. Each garment hanger 100 comprises a unitary frame body 102 comprising shoulders 104 and a top hook 106 for engaging with a support bar 202. The pair of shoulders 104 extending outwardly and angled downwardly from opposite sides 106*a*/106*b* of the top hook 106, thereby forming a triangular shape below the top hook 106. The top hook 106 includes an integrated garment spacer 108 wherein the integrated garment spacer 108 is defined as depth 110*a* greater than the depth 110*b* of the pair of shoulders 104 of the unitary frame body 102. The top hook 106 provides for the maintaining of space between hung garments 112 by allowing the top hooks 106 of adjacent hangers 100 to touch while preventing contact between the hung garments 112. The top hook 106 is configured for hanging the garment hanger 100 on the support bar 202. Each shoulder 104 and top hook 106 have a geometrical cross section defining an upper flange 114*a* and a lower flange 116*a* connected by a web 118*a*. The cross section is maintained continuously throughout the shoulders 104. When multiple garment hangers 100 of the plurality are hung adjacently on the support bar 202, the integrated garment spacers 108 of adjacent hangers 100 contact each other, creating uniform spacing between hangers 100. The wider configuration of the top hooks 106 (compared to current garment hanger hooks) maintain a predetermined distance 204 between garments 112 hung on adjacent hangers 100, thereby reducing contact and wrinkling between the garments 112.

In some embodiments, the garment hanger 100 of the system 200 further comprises a crossbar 122 having distal ends 122*a*/122*b*.The pair of shoulders 104 form into the distal ends 122*a*/122*b* of the crossbar 122.

In some embodiments, the crossbar 122, shoulders 104, and top hook 106 of the garment hanger 100 of the system 200 each comprise a geometrical cross section defining an upper flange 114*a*/114*b*/114*c* and a lower flange 116*a*/116*b*/116*c* connected by a web 118*a*/118*b*/118*c*, wherein the upper flange 114*a*/114*b*/114*c*, web 118*a*/118*b*/118*c*, and lower flange 116*a*/116*b*/116*c* form a generally H-shaped profile lower flange 120*a*/120*b*/120*c* when viewed in cross-section.

In some embodiments of the system 200, a width 124 of said unitary frame body 102 of said garment hanger 100 is elongated beyond a standard garment hanger to prevent garments from sliding off of the unitary frame body 102.

In some embodiments of the system, a width 124 of said unitary frame body 102 is approximately 2 inches wider than a standard hanger to prevent bumps in shirt shoulders.

In some embodiments of the system 200, a top surface 126 of each shoulder 104 of each garment hanger 100 includes an integral textured area 132 configured to reduce slippage of an engaged garment by providing a gripping top surface 126. In some embodiments, top surface 126 includes ribs 126*a*.

In some embodiments of the system 200, the top hook 106 is ¾ inches wide and the shoulders 104 are each ⅜ inches wide, thereby defining the spacer 108 as a depth 110*a* of the top hook 106 greater than the depth 110*b* of the unitary frame body 102, whereby the top hook 106 provides for the maintaining of space between hung garments 112 by allowing the top hooks 106 of adjacent hangers 100 to touch while preventing contact between the hung garments 112.

In some embodiments of the system 200, each garment hanger 100 further comprises notches 128 on top sides 126 of the pair of shoulders 104 for hanging tank tops and thin garments 112.

In a further exemplary embodiment, as illustrated in FIG. 11, a method 300 of organizing garments 112 to promote wrinkle-free storage and an organized appearance is disclosed. The method 300 comprises providing 302 a support bar 202 for garment hangers 100 to hang and providing 304 a plurality of garment hangers 100. Each garment hanger 100 comprises a unitary frame body 102 with a pair of shoulders 104 and a top hook 106, the top hook 106 for engaging with a support bar 202, thereby forming a structure to support a garment 112. The step of providing 304 a plurality of garment hangers 100 comprises configuring 306 each pair of shoulders 104 to extend outwardly and angle downwardly from opposite 106*a*/106*b* sides of the top hook 106, thereby forming a triangular shape below the top hook 106, to support the natural shoulder shape of garments 112 and prevent shoulder bumps. The step of providing 304 a plurality of garment hangers 100 also comprises forming 324 the top hook 106 of each hanger 100 with an integrated garment spacer 108, the integrated garment spacer 108 having a depth 110*a* greater than the depth 110*b* of the pair of shoulders 104, to maintain space 204 between hung garments 112 by allowing the top hooks 106 of adjacent hangers 100 to touch while preventing contact between the hung garments 112, thereby reducing wrinkling. The step of providing 304 a plurality of garment hangers 100 also comprises forming 326 a contact surface 130 on each side of the top hook 106 as part of the integrated garment spacer 108, wherein the contact surface 130 is configured to abut against contact surfaces of adjacent hangers, to maintain space between hung garments 112 by allowing the contact surfaces 130 of adjacent hangers 100 to touch while preventing contact between the hung garments 112. The step of providing 304 a plurality of garment hangers 100 also comprises maintaining 308 a continuous geometrical cross section throughout each unitary frame body 102, the cross section defining an upper flange 114*a*/114*b*/114*c* and a lower flange 116*a*/116*b*/116*c* connected by a web 118*a*/118*b*/118*c*, thereby configuring the frame to form a generally H-shaped profile when viewed in cross-section, to provide reduced weight compared to a solid frame of similar dimensions and improved strength and rigidity. The step of providing 304 a plurality of garment hangers 100 also comprises ensuring 310 the continuous geometrical cross section in each hanger 100 maintains consistent strength and rigidity throughout the entire frame 102, to provide improved weight distribution for supporting heavier garments 112 without bending or deforming. The step of providing 304 a plurality of garment hangers also comprises including 312 a crossbar 122 in each hanger 100 connecting distal ends 122*a*/122*b* of the pair of shoulders 104, wherein the pair of shoulders 104 form into the distal ends 122*a*/122*b* of the crossbar 122, to provide additional structural support and maintain the shape of the garment hanger 100 under a load. The step of providing 304 a plurality of garment hangers 100 also comprises texturing 314 a top surface 126 of each shoulder 104 in each garment hanger 100, the textured area 132 including ribs 126*a*, to reduce slippage of engaged garments 112 by providing a gripping surface 132, thereby ensuring garments 112 remain securely in place. The step of providing 304 a plurality of garment hangers 100 also comprises providing 316 notches 128 on top sides 126 of the pair of shoulders 104 in each garment hanger 100 for hanging garments 112 with straps, such as tank tops and dresses, to prevent garments 112 from sliding off the hanger 100 and to maintain a neat and organized appearance. The step of providing 304 a plurality of garment hangers 100 also comprises configuring 318 each unitary frame body 102 to be elongated in width beyond a standard garment hanger, approximately 2 inches wider, to prevent bumps in shirt shoulders and accommodate larger garments. The step of providing 304 a plurality of garment hangers 100 also comprises maintaining 320 uniform spacing between hangers 100 when the plurality of garment hangers 100 are hung adjacently on the support bar 202, wherein the contact surfaces 130 of the integrated garment spacers 108 of adjacent hangers 100 contact each other, to provide consistent airflow between garments 112 hung on adjacent hangers 100, thereby reducing the likelihood of moisture build-up and odors. The step of providing 304 a plurality of garment hangers 100 also comprises enhancing 322 overall structural design of each hanger 100, wherein the continuous geometrical cross section provides reduced weight, increased strength, consistent rigidity, and improved weight distribution, to facilitate the use of the garment hangers 100 for a wide range of garment 112 types, from lightweight fabrics to heavy coats, without compromising the integrity of the hangers or the condition of the garments 112.

While there has been shown and described above the preferred embodiment of the instant invention, it is to be appreciated that the invention may be embodied otherwise than is herein specifically shown and described. Certain changes may be made in the form and arrangement of the parts without departing from the underlying ideas or principles of this invention as set forth in the Claims appended herewith. It should be understood that the proportions and dimensions shown in the accompanying drawings are for illustrative purposes only and should not be taken as limiting the scope of the present invention. The actual dimensions and proportions of the various elements of the garment hanger may vary depending on specific applications, manufacturing processes, or design preferences, while still embodying the principles of the invention as claimed.

I claim:

1. A garment hanger for promoting wrinkle-free storage and organization, comprising:

a unitary frame body comprising a pair of shoulders and a hook-shaped garment spacer for engaging with a support bar;

said pair of shoulders extending outwardly and angled downwardly from opposite sides of the hook-shaped garment spacer, thereby forming a triangular shape below said hook-shaped garment spacer;

said hook-shaped garment spacer defines a monolithically integrated geometry having a depth greater than the depth of the pair of shoulders, whereby the hook-shaped garment spacer provides for the maintaining of space between hung garments by allowing the hook-shaped garment spacers of adjacent hangers to touch while preventing contact between the hung garments;

wherein said hook-shaped garment spacer further comprises a continuous linear contact surface on each side of the hook-shaped garment spacer, said contact surface configured to abut against contact surfaces of adjacent hangers, whereby the hook-shaped garment spacer maintains space between hung garments by allowing the contact surfaces of adjacent hangers to touch while preventing contact between the hung garments;

wherein each shoulder in said pair of shoulders comprise a geometrical cross-section defining an upper flange and a lower flange connected by a web, said cross-section maintained continuously throughout the shoulders, wherein the upper flange, web, and lower flange form a generally H-shaped profile when viewed in cross-section; and wherein said hook-shaped garment spacer comprises a geometrical cross-section defining an upper flange and a lower flange connected by a web, said cross-section maintained continuously throughout the hook-shaped garment spacer, wherein the upper flange, web, and lower flange form a generally H-shaped profile when viewed in cross-section.

2. The garment hanger for promoting wrinkle-free storage and organization, as recited in claim 1, further comprising:

a crossbar having distal ends, wherein the pair of shoulders form into the distal ends of the crossbar.

3. The garment hanger for promoting wrinkle-free storage and organization, as recited in claim 2, wherein said crossbar comprises a geometrical cross-section defining an upper flange and a lower flange connected by a web, said cross-section maintained continuously throughout the crossbar, wherein the upper flange, web, and lower flange form a generally H-shaped profile when viewed in cross-section.

4. The garment hanger for promoting wrinkle-free storage and organization, as recited in claim 1, wherein a width of said frame body is elongated beyond 19 inches to prevent garments from sliding off of the frame body.

5. The garment hanger for promoting wrinkle-free storage and organization, as recited in claim 4, wherein a width of said frame body is approximately 19 inches to 21 inches to prevent bumps in shirt shoulders.

6. The garment hanger for promoting wrinkle-free storage and organization, as recited in claim 1, wherein a top surface of each shoulder of each the garment hanger includes an integral textured area configured to reduce slippage of an engaged garment by providing a gripping surface.

7. The garment hanger for promoting wrinkle-free storage and organization, as recited in claim 6, wherein said top surface includes ribs.

8. The garment hanger for promoting wrinkle-free storage and organization, as recited in claim 1, wherein the hook-shaped garment spacer is ¾ inches wide and the shoulders are ⅜ inches wide, thereby defining the monolithically integrated geometry as a depth greater than the depth of the shoulders, whereby the hook-shaped garment spacer provides for the maintaining of space between hung garments by allowing the hook-shaped garment spacer of adjacent hangers to touch while preventing contact between the hung garments.

9. The garment hanger for promoting wrinkle-free storage and organization, as recited in claim 1, wherein the garment hanger further comprises notches on top sides of the pair of shoulders for hanging tank tops and thin garments.

10. A garment hanging system for maintaining organized and wrinkle-free storage of multiple garments, comprising:

a support bar;

a plurality of garment hangers configured to hang on the support bar, wherein each garment hanger comprises:

a unitary frame body comprising a pair of shoulders, a hook-shaped garment spacer for engaging with the support bar, and a crossbar having distal ends, wherein the pair of shoulders form into the distal ends of the crossbar;

said pair of shoulders extending outwardly and angled downwardly from opposite sides of the hook-shaped garment spacer, thereby forming a triangular shape below said hook-shaped garment spacer;

said hook-shaped garment spacer defining a monolithically integrated geometry having a depth greater than the shoulders of the unitary frame body, whereby the hook-shaped garment spacer provides for the maintaining of space between hung garments by allowing the hook-shaped garment spacers of adjacent hangers to touch while preventing contact between the hung garments;

said hook-shaped garment spacer configured for hanging the garment hanger on the support bar;

each of the shoulders, the crossbar, and the hook-shaped garment spacer having a geometrical cross-section defining an upper flange and a lower flange connected by a web wherein the upper flange, web, and lower flange form a generally H-shaped profile when viewed in cross-section; and said cross-section maintained continuously throughout the shoulders;

whereby, the hook-shaped garment spacers of adjacent hangers contact each other when multiple garment hangers of the plurality are hung adjacently on the support bar, creating uniform spacing between hangers; and the geometry of the hook-shaped garment spacer maintains a predetermined distance between garments hung on adjacent hangers, thereby reducing contact and wrinkling between the garments.

11. The garment hanging system for maintaining organized and wrinkle-free storage of multiple garments, as recited in claim 10, wherein said hook-shaped garment spacer of each garment hanger further comprises a contact surface on each side of the hook-shaped garment spacer, said contact surface configured to abut against contact surfaces of adjacent hangers, whereby the monolithically integrated geometry of the hook-shaped garment spacer maintains space between hung garments by allowing the contact surfaces of adjacent hangers to touch while preventing contact between the hung garments.

12. The garment hanging system for maintaining organized and wrinkle-free storage of multiple garments, as recited in claim 10, wherein a width of said unitary frame body of each garment hanger of the plurality of garment hangers is elongated beyond 19 inches to prevent garments from sliding off of the unitary frame body.

13. The garment hanging system for maintaining organized and wrinkle-free storage of multiple garments, as recited in claim 12, wherein a width of said unitary frame body is approximately 19 inches to 21 inches to prevent bumps in shirt shoulders.

14. The garment hanging system for maintaining organized and wrinkle-free storage of multiple garments, as recited in claim 10, wherein a top surface of each shoulder of each garment hanger includes an integral textured area configured to reduce slippage of an engaged garment by providing a gripping surface.

15. The garment hanging system for maintaining organized and wrinkle-free storage of multiple garments, as recited in claim 14, wherein said top surface includes ribs.

16. The garment hanging system for maintaining organized and wrinkle-free storage of multiple garments, as recited in claim 10, wherein the hook-shaped garment spacer is ¾ inches wide and the shoulders are each ⅜ inches wide, thereby defining the monolithically integrated geometry as a depth greater than the depth of the unitary frame body, whereby the hook-shaped garment spacer provides for the maintaining of space between hung garments by allowing the hook-shaped garment spacer of adjacent hangers to touch while preventing contact between the hung garments.

17. The garment hanging system for maintaining organized and wrinkle-free storage of multiple garments, as recited in claim 10, wherein each garment hanger further comprises notches on top sides of the pair of shoulders for hanging tank tops and thin garments.

18. A method of organizing garments to promote wrinkle-free storage and an organized appearance, comprising:

providing a support bar for garment hangers to hang; and providing a plurality of garment hangers, wherein each garment hanger comprises a unitary frame body with a pair of shoulders and a hook-shaped garment spacer, said hook-shaped garment spacer for engaging with the support bar, thereby forming a structure to support a garment, whereby said step of providing a plurality of garment hangers further comprises:

configuring each pair of shoulders to extend outwardly and angle downwardly from opposite sides of the hook-shaped garment spacer, thereby forming a triangular shape below said hook-shaped garment spacer, to support the natural shoulder shape of garments and prevent shoulder bumps;

forming the hook-shaped garment spacer of each hanger with a monolithically integrated geometry having a depth greater than the depth of the pair of shoulders, to maintain space between hung garments by allowing the hook-shaped garment spacers of adjacent hangers to touch while preventing contact between the hung garments, thereby reducing wrinkling;

forming a contact surface on each side of the hook-shaped garment spacer, wherein the contact surface is configured to abut against contact surfaces of adjacent hangers, to maintain space between hung garments by allowing the contact surfaces of adjacent hangers to touch while preventing contact between the hung garments;

maintaining a continuous geometrical cross-section throughout each unitary frame body, said cross-section defining an upper flange and a lower flange connected by a web, thereby configuring the frame to form a generally H-shaped profile when viewed in cross-section, to provide reduced weight compared to a solid frame of similar dimensions and improved strength and rigidity;

ensuring the continuous geometrical cross-section in each hanger maintains consistent strength and rigidity throughout the entire frame, to provide improved weight distribution for supporting heavier garments without bending or deforming;

including a crossbar in each hanger connecting distal ends of the pair of shoulders, wherein the pair of shoulders form into the distal ends of the crossbar, to provide additional structural support and maintain the shape of the garment hanger under load;

texturing a top surface of each shoulder in each garment hanger, said textured surface including ribs, to reduce slippage of engaged garments by providing a gripping surface, thereby ensuring garments remain securely in place;

providing notches on top sides of the pair of shoulders in each garment hanger for hanging garments with straps, such as tank tops and dresses, to prevent garments from sliding off the hanger and to maintain a neat and organized appearance;

configuring each unitary frame body to be elongated in width approximately 19 inches to 21 inches to prevent bumps in shirt shoulders and accommodate larger garments;

maintaining uniform spacing between hangers when said plurality of garment hangers are hung adjacently on the support bar, wherein the contact surfaces of the hook-shaped garment spacers of adjacent hangers contact each other, to provide consistent airflow between garments hung on adjacent hangers, thereby reducing the likelihood of moisture build-up and odors; and enhancing overall structural design of each hanger, wherein the continuous geometrical cross-section provides reduced weight, increased strength, consistent rigidity, and improved weight distribution, to facilitate the use of the garment hangers for a wide range of garment types, from lightweight fabrics to heavy coats, without compromising the integrity of the hangers or the condition of the garments.

* * * * *